United States Patent [19]

Honma

[11] 4,273,452

[45] Jun. 16, 1981

[54] PRINT HEAD FOR A DOT PRINTER

[75] Inventor: Hiroshi Honma, Yokohama, Japan

[73] Assignee: Tokyo Shibaura Denki Kabushiki Kaisha, Kawasaki, Japan

[21] Appl. No.: 76,926

[22] Filed: Sep. 19, 1979

[30] Foreign Application Priority Data

Sep. 29, 1978 [JP] Japan ..... 53-133785

[51] Int. Cl.[3] ..... B41J 3/12

[52] U.S. Cl. ..... 400/124; 101/93.05

[58] Field of Search ..... 400/124; 101/93.05; 16/108, 109; 416/187

[56] References Cited

U.S. PATENT DOCUMENTS 3,896,918 7/1975 Schneider ..... 400/124

FOREIGN PATENT DOCUMENTS 2056364 5/1972 Fed. Rep. of Germany ..... 400/124

*Primary Examiner*—Paul T. Sewell

*Attorney, Agent, or Firm*—Cushman, Darby & Cushman

[57] ABSTRACT

A print head for a dot printer consisting of electromagnet units for driving a plurality of print wires, wherein the electromagnet unit is formed of a plurality of electromagnets and a plurality of armatures which are all assembled into a single magnetic circuit member; and the magnetic circuit member comprises a boss common to the electromagnets, yokes formed of radially arranged arms extending from the boss and parallel arranged arms extending in parallel from the outer ends of the radially arranged arms substantially at right angles thereto, magnetizing pole pieces extending from the intermediate portions of the radially arranged arms in parallel with the parallel arranged arms, and a yoke arm deformation-preventing ring connected to the outer ends of all the parallel arranged arms.

1 Claim, 4 Drawing Figures

PRINT HEAD FOR A DOT PRINTER

BACKGROUND OF THE INVENTION

This invention relates to a print head for a dot printer. Various types of print head are used for a dot printer. The prior art print head is generally constructed and operated in the following manner. Electromagnets are separately manufactured in the same number as the print wires used. The electromagnets are fitted to a suitable frame. When the electromagnets are energized, the corresponding wires are pushed to a platen, thereby impressing dots on a sheet of print paper by means of the forward end printing portion of a print wire. However, the customary practice to separately produce many electromagnets has the drawbacks that a large number of parts are required; and the working, assembly and adjustment of parts consume much time, thus increasing the cost of a print head. To eliminate these difficulties, various print heads have been proposed, but without success.

One of the prior art proposed print heads in constructed, as shown in FIGS. 1 and 2, by producing a magnetic circuit in one piece to facilitate the integral manufacture of a plurality of electromagnets constituting an electromagnet unit. Referring to a magnetic circuit member denoted by the general reference numeral 18, the parts indicated by the reference numerals 10, 12 are respectively a pole piece and yoke jointly constituting a magnetic circuit of one electromagnet. The pole piece 10 is fitted with a magnetizing coil (not shown). When current runs through the coil, then the pole piece attracts an armature (not shown) lying near the pole piece and yoke. This attraction causes dots to be impressed by a print wire (not shown). The magnetic circuit member 18 of FIG. 1 can be easily assembled into nine electromagnets. This construction can indeed prominantly eliminate the aforesaid drawbacks of the prior art print head. However, this type of the known print head has been found still to have defects requiring improvement. The reason for this is as follows. As seen from FIG. 1, the yokes 12 extend in spaced relation for a considerable distance. Since the magnetic circuit member 18 is manufactured mainly by lost wax casting, the yokes 12 are invariably bent outward as illustrated in FIG. 2. The sections defined by dots-dash lines denote the proper position 12a of the yoke 12. The magnetic circuit member 18, of which the yokes 12 are bent outward cannot be put to practional use just as manufactured, making it necessary to carry out the subsequent correction of the defective portion. This correction which is generally undertaken by the hand calls for high skill and consumes a great deal of time. Accordingly, it has been demanded to develop magnetic circuit elements free from the above-mentioned deformation.

SUMMARY OF THE INVENTION

It is accordingly the object of this invention to provide a print head for a dot printer which is free from the aforesaid drawbacks of the prior art print head for a dot printer, and is constructed of a high quality magnetic circuit member little subject to deformation though integrally manufactured.

To attain the above-mentioned object, this invention provides a print head for a dot printer which comprises:

a plurality of print wires each provided with a printing portion at the forward end;

printing portion guiding means, which, when the print wires are moved lengthwise, guides the forward end printing portions of the print wires in a proper direction; and an electromagnet unit for driving the selected print wires for impression of characters in dots.

The electromagnet unit comprises electromagnets and armatures provided for the respective print wires. The armatures are attracted to the energized electromagnets to drive the print wires. The magnetic circuit of the electromagnets included in the electromagnet unit is formed of an integrally formed magnetic circuit member. The magnetic circuit member comprises a boss common to the respective electromagnets; yokes formed of arms radially extending from the boss at a space from each other for substantially the same length and reaching approximately the same circumference to be pressed, when required, against the print wires arranged equidistantly in the circumferential direction and another group of arms extending almost in parallel along the axis of said circumference at a space from each other for the prescribed distance and in the same direction; pole pieces for magnetizing coils used with the respective electromagnets which extend from the radially arranged arms substantially in parallel with the aforesaid parallel arranged arms at the prescribed space; and a ring connected to the outer ends of all the parallel yoke arms to prevent their deformation.

The print head of this invention used with a dot printer is provided, as described above, with a ring for preventing the deformation of the parallel yoke arms. Accordingly, the yoke arms of the magnetic circuit member are not subject to deformation during or after the manufacture of a print head. Therefore, a correction operation hitherto required to eliminate the deformation of the aforesaid yoke arms can be dispensed with, thereby decreasing the cost of a print head.

DETAILED DESCRIPTION OF THE PREFERRED EMBODIMENT

Figure 3:
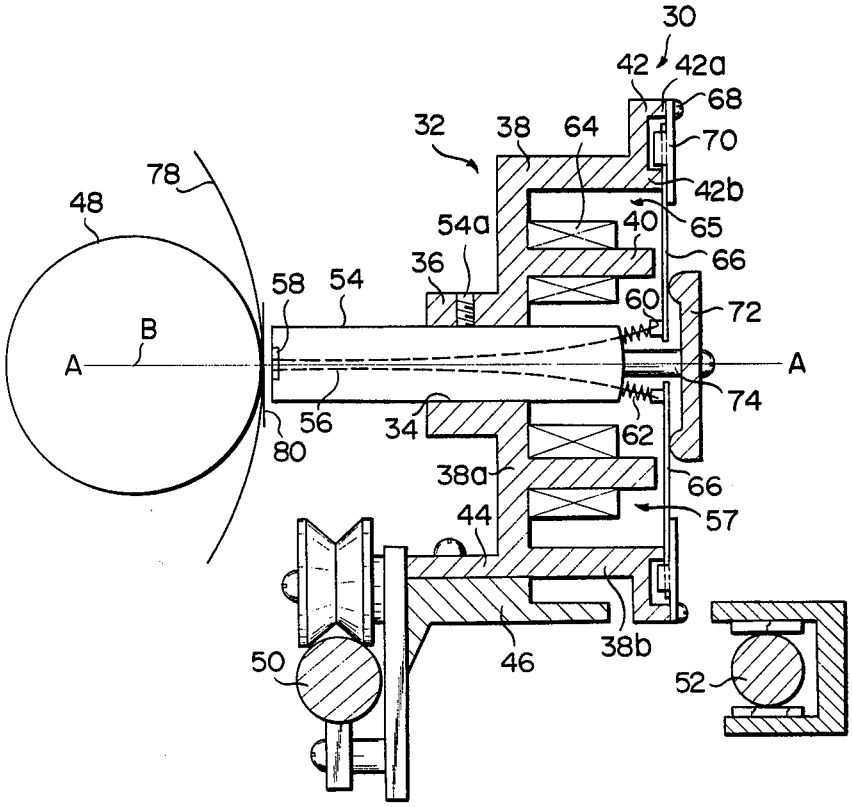
FIG. 3 is a fractional sectional view of the print head of the invention and the associated arrangement.

There will now be described by reference to FIGS. 3 and 4 a print head for a wire dot printer embodying this invention. Referring to FIG. 3, a magnetic circuit member 32 used with a print head 30 comprises a cylindrical boss 36 provided with a penetrating hole 34; a plurality of yokes 38 radially extending from the boss 36 substantially at right angles to the axis A—A of said boss 36 at a space 37 (FIG. 4) from each other; pole piece 40 used with magnetizing coils and connected to the yokes 38; and a yoke arm deformation-preventing ring 42. The yokes 38 have radially extending arms **38*a* set substantially at right angles to the boss axis A—A and another group of arms 38*b* projecting from said radially extending arms 38*a*** at right angles thereto substantially in parallel with the boss axis A—A, to the left side of FIG.

3, that is, to the front side of the print head 30. The pole pieces 40 project from the radially extending arms 38*a* in parallel with the boss axis A—A to the right side of FIG. 3, that is, to the rear side of the print head 30. The yoke arm deformation-preventing ring 42 is connected to the outer ends of all the parallel arranged arms 38*b* of the yoke 38.

Figure 1:
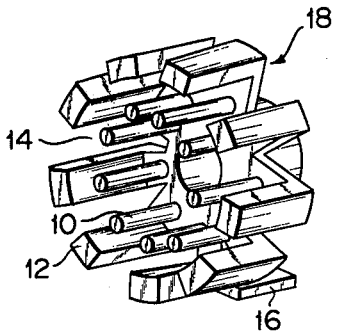
FIG. 1 (PRIOR ART)
FIG. 1 is an oblique view of the prior art magnetic circuit member.
Figure 2:
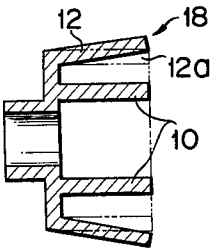
FIG. 2 (PRIOR ART)
FIG. 2 is an enlarged longitudinal sectional view of the magnetic circuit member of FIG. 1, showing the deformation of the parallel yoke arms included in said member.
Figure 4:
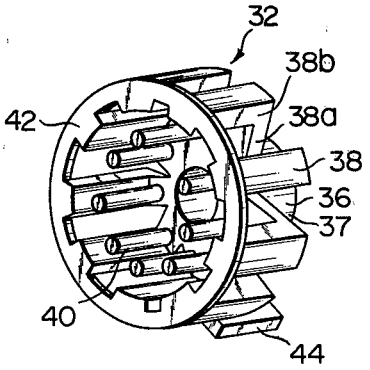
FIG. 4 is an oblique view of the main section of the magnetic circuit member used with the print head of FIG. 3.

Referring to FIG. 4, an oblique view of the magnetic circuit member 32, reference numeral 44 denotes a fitting member for fixing the magnetic circuit member 32 to a carriage 46 (FIG. 3). Mounted on the surface of the yoke arm deformation-preventing ring 42 are projections 42*a*, 42*b* for holding an armature 66 as described later.

FIG. 3 indicates the main section of the print head 30 formed of the magnetic circuit member 32 and associated arrangement. Reference numeral 48 is a cylindrical platen which is so positioned as to cause the boss axis A—A to pass through the center B of the cross section of the platen 48. The magnetic circuit member 32 is fixed to the carriage 46 by the fitting member 44. The carriage 46 is moved along the guide shafts 50, 52 in parallel with the platen 48, that is, the surface of a sheet of print paper.

A print wire guide assembly 54 is inserted into a hole 34 drilled throughout the boss 36 of the magnetic circuit member 32 concentrically with the boss axis A—A. The print wire guide assembly 54 is fixed to the magnetic circuit member 32 by a screw 54*a*. Broken lines indicated in the print wire guide assembly 54 by reference numeral 56 denote print wires provided in the prescribed number. A printing portion is formed at the foremost end of each print wire. The printing portion moves forward and backward relative to the platen by being guided by a printing portion-guiding member 58. The rear end portion of each print wire 56 projects from the print wire guide assembly 54. A coil spring 62 is stretched between a print wire drive member 60 fitted to the rear end of the print wire 56 and the rear end wall of the print wire guide assembly 54. The print wire 56 is normally urged by said coil spring 62 as to cause the printing portion to be removed from the platen 48.

A magnetizing coil 64 is wound about the respective pole pieces 40 of the magnetic circuit member 32. The coil 64, pole piece 40 and yoke 38 jointly constitute an electromagnet 65. Electromagnets 65 having the same number as the print wires 56 which are integrally fabricated are hereinafter referred to as "an electromagnet unit 57". Armatures 66 are attracted by the corresponding electromagnets 65 constituting said electromagnet unit 57. The outer portion of the armature 66 is swingable supported by the outer ends of the parallel extending arms 38*b* and the yoke arm deformation-preventing ring 42. The inner portion of the armature 66 extends toward the boss axis A—A. When the armature 66 is actuated, said inner portion pushes the drive member 60 fitted to the rear end of the print wire 56 and consequently said print wire 56 toward the platen 66 substantially in parallel with the boss axis A—A. The yoke arm deformation-preventing ring 42 of FIG. 3 are provided with projections 42*a*, 42*b*. The outer end of the armature 66 extends beyond the projection 42*b* to the outside and is fixed to the inner end of a plate spring 70 fitted to the projection 42*a* by a screw 68. Reference numeral 72 of FIG. 3 is a stopper fitted to a shaft 74 projecting from the rear end of the wire guide assembly 54. This stopper 72 prevents the inner end portion of the armature 66 from moving excessively rearward.

Reference numeral 78 of FIG. 3 is print paper, and reference numeral 80 is a print ribbon. The diameter of a print wire is selected in accordance with the form of characters such as the alphabet or Chinese characters or the size thereof. The electromagnets 65 and corresponding armatures 66 are provided in the same number as the print wires used. The rear end portions of the print wires 56 are equidistantly set along a circumference centered at the boss axis A—A, and the forward end portions of the print wires 56 which face the platen 48 move forward and backward relative to the platen 48 while being guided by the printing portion-guiding member 58 with a substantially equal lengthwise interval mention between the respective print wires 56. The print wires 56 are generally arranged in one or two rows.

Where a dot printer is put into operation, the carriage 46 is moved upon receipt of a control signal sent forth from a control circuit (not shown) belonging to the dot printer. As a result, the electromagnets 65 are energized to drive one or a plurality of print wires selected in accordance with the kind of character being impressed and the position of the carriage 46. The electromagnets 65 are energized by current running through the coils 64 thereof. The energized electromagnets 65 attract the corresponding armatures 60 which in turn are moved to drive the print wires 56. The print wires 56 corresponding to the selected electromagnets 65 are pushed toward the peripheral surface of the platen 48 through a print ribbon 80 to impress a dot on a sheet of print paper 78. When current supply to the electromagnets 65 is stopped, then the armatures 66 cease to be attracted by said electromagnets 65. As a result, the print wires 56 are removed from the platen 48 by the action of the coil spring 62. The above-mentioned operation is repeated, until selected characters are impressed on a sheet of print paper 78.

The print head 30 of this invention is operated as described by reference to FIG. 3. The magnetic circuit member 32 used with the print head 30 comprises a plurality of L-shaped yokes 38 radially extending from the boss 36. Said L-shaped yokes 38 are generally manufactured by the lost wax casting process. Since, however, the outer ends of the L-shaped yokes 38 are connected together by the yoke arm deformation-preventing ring 42, the yoke arms are prevented from bending outward as is observed in the yoke arms of the prior art magnetic circuit member 32 which is not provided with the yoke arm deformation-preventing ring 42. Therefore, the magnetic circuit member 32 of this invention provided with the yoke arm deformation-preventing ring 42 saves the work of correcting the aforesaid deformation which might otherwise occur after the L-shaped yokes 38 are cast, prominantly reducing the manufacturing cost of the printing head 30.

What is claimed is:

1. A print head for a dot printer, which comprises:

a plurality of print wires each provided with a printing portion at the forward end;

printing portion guiding means for guiding the respective forward end printing portions of the print wires in a given direction when the print wires are lengthwise driven; and an electromagnet unit for driving the selected print wires to impress characters in dots, which comprises electromagnets and armatures provided for the respective print wires, and in which the armatures, when attracted by the electromagnets, drive the print wires and wherein the magnetic circuit of the electromagnet unit consists of an integrally formed circuit member; said magnetic circuit member comprising:

a boss common to the electromagnets; yokes for the respective electromagnets which yokes comprise radially arranged arms provided in the same number as the print wires and radially extending from the boss for substantially the same distance spaced from each other to reach approximately the same circumference, said circumference defining an axis, and parallel arranged arms extending from the outer ends of the radially arranged arms approximately in parallel with the axis of said circumference for a given distance in the same direction spaced from each other; pole pieces for magnetizing coils for mounting the respective electromagnets which pole pieces extend from the radially arranged yoke arms substantially in parallel with the parallel arranged arms at the prescribed space therefrom; and a yoke arm deformation-preventing ring connected to the outer ends of all the parallel-arranged arms.

* * * * *